US008614541B2

(12) United States Patent
Walker, Jr.

(10) Patent No.: US 8,614,541 B2
(45) Date of Patent: Dec. 24, 2013

(54) SPARK PLUG WITH CERAMIC ELECTRODE TIP

(75) Inventor: William J. Walker, Jr., Toledo, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/279,418

(22) Filed: Oct. 24, 2011

(65) Prior Publication Data

US 2012/0126682 A1 May 24, 2012

Related U.S. Application Data

(63) Continuation-in-part of application No. 12/200,244, filed on Aug. 28, 2008, now Pat. No. 8,044,561, and a continuation-in-part of application No. 12/201,590, filed on Aug. 29, 2008, now Pat. No. 8,044,565.

(51) Int. Cl.
*H01T 13/20* (2006.01)

(52) U.S. Cl.
USPC ..... 313/141; 445/7

(58) Field of Classification Search
USPC ..... 313/118–145; 123/32, 41, 143 R, 123/146.5 R, 169 P, 260, 280, 169 R, 169 EL, 123/310
See application file for complete search history.

(56) References Cited

U.S. PATENT DOCUMENTS

| | | | | |
|---|---|---|---|---|
| 3,673,452 A | | 6/1972 | Brennen | |
| 3,725,715 A | | 4/1973 | Krow | |
| 3,988,646 A | | 10/1976 | Atkins et al. | |
| 4,261,085 A | | 4/1981 | Nishio | |
| 4,369,343 A | | 1/1983 | Sone et al. | |
| 4,396,855 A | | 8/1983 | Imai et al. | |
| 4,400,643 A | | 8/1983 | Nishio | |
| 4,406,968 A | | 9/1983 | Friese | |
| 4,427,915 A | * | 1/1984 | Nishio et al. | 313/141 |
| 4,514,657 A | * | 4/1985 | Igashira et al. | 313/130 |
| 4,519,784 A | | 5/1985 | Pollner | |
| 4,659,960 A | | 4/1987 | Toya | |
| 4,713,582 A | | 12/1987 | Yamada et al. | |
| 4,737,253 A | * | 4/1988 | Gesing et al. | 204/247.3 |

(Continued)

FOREIGN PATENT DOCUMENTS

EP 0635920 A1 1/1995

OTHER PUBLICATIONS

International Search Report for PCT/US2009/054154 dated Mar. 31, 2010, 2 pages.

(Continued)

*Primary Examiner* — Donald Raleigh
(74) *Attorney, Agent, or Firm* — Robert L. Stearns; Dickinson Wright, PLLC

(57) ABSTRACT

A spark plug (20) for igniting a mixture of fuel and air of an internal combustion engine comprises a center electrode (22) and a ground electrode (24). At least one of the electrodes (22, 24) includes a body portion (28, 30) formed of thermally conductive material and a firing tip (32, 34) disposed on the body portion (28, 30). The firing tip (32, 34) includes a ceramic material, providing an exposed firing surface (36, 38). The ceramic material is an electrically conductive, monolithic ceramic material. Examples of preferred ceramic materials include titanium diboride, silicon carbide, ternary carbide, and ternary nitride. The ceramic material can also include oxides, borides, nitrides, carbides, silicides, or MAX phases.

21 Claims, 2 Drawing Sheets

(56) References Cited

U.S. PATENT DOCUMENTS

| | | | | |
|---|---|---|---|---|
| 5,189,333 | A | 2/1993 | Kagawa et al. | |
| 5,321,943 | A * | 6/1994 | Schmid et al. | 57/417 |
| 5,493,171 | A * | 2/1996 | Wood et al. | 313/141 |
| 6,008,547 | A * | 12/1999 | Dobler et al. | 307/10.1 |
| 6,160,342 | A | 12/2000 | Nishikawa | |
| 6,533,628 | B1 | 3/2003 | Matsutani | |
| 7,388,323 | B2 | 6/2008 | Shibata et al. | |
| 7,768,184 | B2 | 8/2010 | Hanashi et al. | |
| 2002/0023914 | A1 * | 2/2002 | Kitagawa et al. | 219/444.1 |
| 2002/0130602 | A1 * | 9/2002 | Kanao et al. | 313/141 |
| 2005/0168121 | A1 * | 8/2005 | Tinwell | 313/141 |
| 2005/0284859 | A1 | 12/2005 | Konishi | |
| 2006/0003091 | A1 * | 1/2006 | Collardey et al. | 427/105 |
| 2007/0080618 | A1 | 4/2007 | Torii et al. | |
| 2007/0290591 | A1 | 12/2007 | Lykowski et al. | |
| 2008/0143229 | A1 | 6/2008 | Walker | |
| 2010/0052497 | A1 | 3/2010 | Walker | |
| 2010/0052498 | A1 | 3/2010 | Walker, Jr. | |
| 2010/0052499 | A1 | 3/2010 | Walker, Jr. | |

OTHER PUBLICATIONS

International Search Report PCT/US2012/054052 mailed on Nov. 22, 2012.

* cited by examiner 28
32
36
42
44
46
48
50
52
82
86
88
$D_1$
$D_2$
$D_3$

SPARK PLUG WITH CERAMIC ELECTRODE TIP

CROSS REFERENCE TO RELATED APPLICATIONS

This application is a Continuation-in-Part and claims the benefit of U.S. patent application Ser. No. 12/200,244, filed Aug. 28, 2008 now U.S. Pat. No. 8,044,561, and U.S. patent application Ser. No. 12/201,590, filed Aug. 29, 2008 now U.S. Pat. No. 8,044,565, which are hereby incorporated by reference in their entirety.

BACKGROUND OF THE INVENTION

1. Field of the Invention

The invention relates generally to ignition devices for internal combustion engines, such as spark plugs, and more particularly to the electrodes therefore.

2. Description of the Prior Art

Internal combustion engines include ignition devices, such as spark ignition devices or spark plugs that extend to the combustion chamber and produce a spark to ignite a mixture of air and fuel. Recent advancements in engine technology are resulting in higher engine operating temperatures to achieve improved engine efficiency. These higher operating temperatures, however, are pushing electrodes of the spark plugs to the very limits of their material capabilities. Presently, Ni-based alloys, including nickel-chromium-iron alloys specified under UNS N06600, such as those sold under the trade names Inconel 600®, Nicrofer 7615®, and Ferrochronin 600®, are typically used as spark plug electrode materials.

As is well known, the resistance to high temperature oxidation of these Ni-based nickel-chromium-iron alloys decreases as their operating temperature increases. Since combustion environments are highly oxidizing, corrosive wear including deformation and fracture caused by high temperature oxidation and sulfidation can result and is particularly exacerbated at the highest operating temperatures. At the upper limits of operating temperature (e.g., 1400° F.), tensile, creep rupture and fatigue strength also have been observed to decrease significantly which can result in deformation, cracking and fracture of the electrodes. Depending on the electrode design, specific operating conditions and other factors, these high temperature phenomena may contribute individually and collectively to undesirable corrosion and erosion of the electrode and diminished performance of the ignition device and associated engine, especially in high performance engines, such as those used in automobile racing.

High temperature firing tips have been employed in conjunction with the electrode materials described. These firing tips have been manufactured from a number of platinum group metals and metal alloys, such as platinum, iridium, rhodium, palladium, ruthenium and rhenium, as pure metals and together with themselves and various other alloy constituents, such as various rare earth elements, in various alloy combinations; gold and gold alloys; tungsten and tungsten alloys and the like. These high temperature firing tips have been attached to a body portion of the electrode materials described above, both center and ground electrodes, in various tip configurations using a wide variety of attachment and joining techniques, including resistance welding, laser welding, mechanical joining and the like, both separately and in various combinations.

Notwithstanding the electrode performance improvements attainable through the use of high temperature firing tips, there remain various aspects of these materials which limit their application and use in ignition device configurations and applications, for example susceptibility to other and new high temperature oxidation, erosion and corrosion mechanisms, such as those associated with small amounts of calcium and phosphorus, thermal expansion mismatch with various center and ground electrode materials and other aspects, such as the high cost of these materials, which serve to limit their usefulness in various ignition applications.

SUMMARY OF THE INVENTION

One aspect of the invention provides a spark plug for igniting a mixture of fuel and air of an internal combustion engine. The spark plug comprises an electrode with a body portion including a thermally conductive material, and a firing tip disposed on the body portion, wherein the firing tip includes a ceramic material. Another aspect of the invention provides the electrode for an ignition device comprising the body portion including the thermally conductive material, and the firing tip disposed on the body portion, wherein the firing tip includes the ceramic material. Yet another aspect of the invention provides a method of forming the spark plug. The method includes providing the electrode by disposing the firing tip including the ceramic material on the body portion including the thermally conductive material.

The electrode for the spark plug or ignition device of the present invention is economical to manufacture and provides a longer useful life, compared to other electrodes used in ignition devices. The combination of the thermally conductive body portion and ceramic firing tip provides resistance to high temperature oxidation, sulfidation, and related corrosion and erosion, while also effectively conducting heat from the firing tip to reduce the operating temperature at the firing tip.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
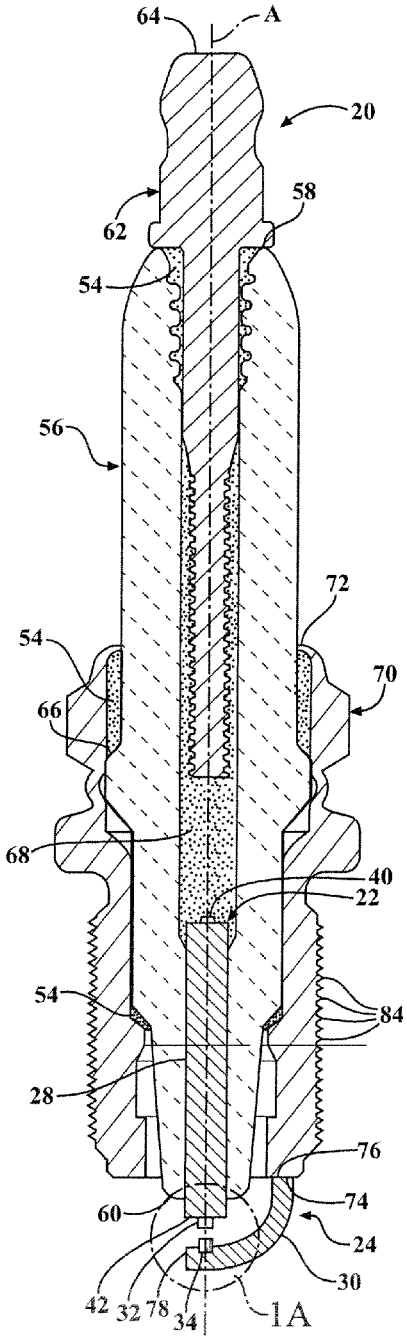
FIG. 1 is a cross-sectional view of a spark plug constructed in accordance with one embodiment of the invention.
Figure 1A:
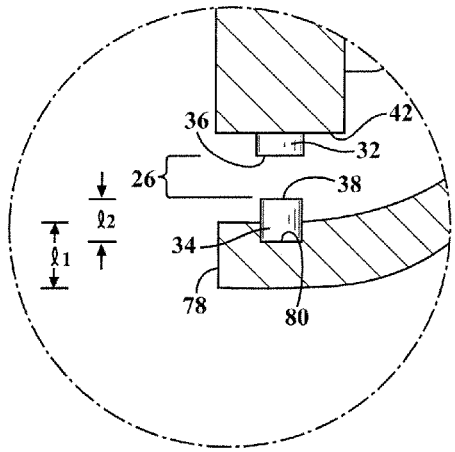
FIG. 1A is an enlarged cross-sectional view of the firing tips of the electrodes of FIG. 1.

One aspect of the invention provides a spark plug 20 for igniting a mixture of fuel and air of an internal combustion engine. As shown in FIGS. 1 and 1A, the spark plug 20 includes a center electrode 22 and a ground electrode 24 providing a spark gap 26 therebetween. At least one of the electrodes 22, 24 includes a body portion 28, 30 formed of a thermally conducive material and a firing tip 32, 34 formed of a ceramic material disposed on the body portion 28, 30. The ceramic material of the firing tip 32, 34 provides a firing surface 36, 38 for emitting a spark to ignite the mixture of fuel and air.

By forming the firing tip 32, 34 of the ceramic material, a lower operating temperature is provided at the firing tip 32, 34. By forming the body portion 28, 30 of a thermally conductive material, heat is effectively conducted away from the ceramic firing tip 32, 34. Thus, the electrode 22, 24 of the present invention, with the thermally conductive body portion 28, 30 and the ceramic firing tip 32, 34, provides a lower operating temperature at the firing tip 32, 34 than other electrodes formed entirely of the ceramic material. The reduced operating temperature at the firing tip 32, 34 extends the life of the spark plug 20. Further, the electrode 22, 24 of the present invention is more economical to manufacture than those with platinum group metal firing tips.

While the electrode 22, 24 is described for use in the particular spark plug 20 application of FIG. 1, it will be appreciated that the electrode 22, 24 having the thermally conductive body portion 28, 30 and the ceramic firing tip 32, 34 can be used in other types of ignition devices.

As shown in FIG. 1, the center electrode 22 extends longitudinally along a center axis A from a center electrode top end 40 to a center firing end 42. The body portion 28, 30 of the center electrode 22, referred to as a center body portion 28, extends from the center electrode top end 40 toward the center firing end 42. The center body portion 28 includes a thermally conductive material and is typically formed entirely of the thermal conductive material, but may be formed of multiple different thermally conductive materials. The center body portion 28 has a thermal conductivity sufficient to draw heat away from a center firing tip 32. In one embodiment, the center body portion 28 has a thermal conductivity of at least 20 Wm-K when measured at 20° C., and preferably at least 35 W/m-K when measured at 20° C. The thermally conductive material of the center body portion 28 is also electrically conductive. The center body portion 28 also typically has an electrically conductivity of at least $9\times10^5$ siemens per meter (S/m). The thermally conductive material is typical metal, preferably nickel or nickel alloy, or a mixture of different metals.

Figures 2, 3, 4, 5, 6, 7, 8, 9, 10, 11:
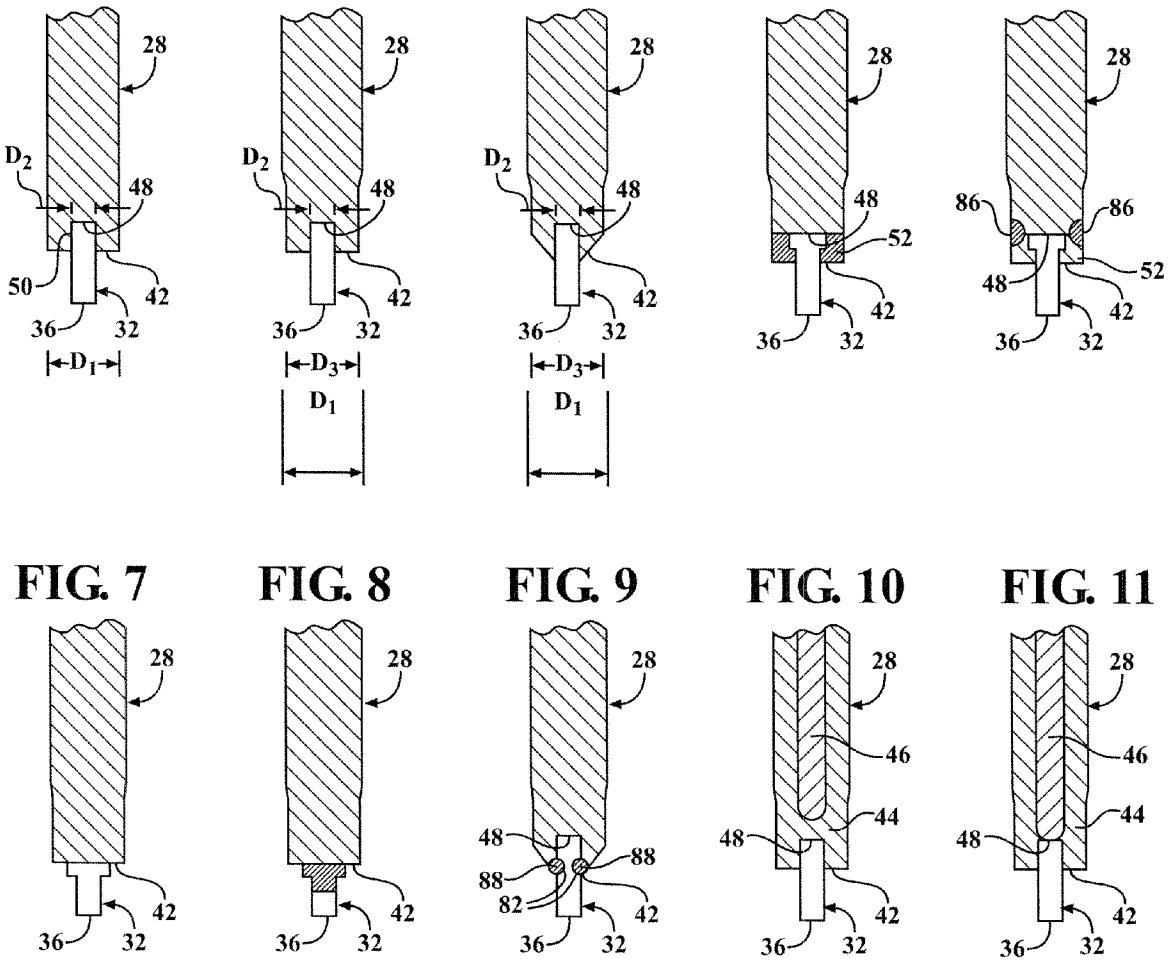
FIGS. 2-11 are cross-sectional views of center electrodes according to other embodiments of the invention, including various different firing tip configurations.

The center electrode 22 can include a variety of different configurations, as shown in FIGS. 2-11. In one embodiment, as shown in FIGS. 10 and 11, the center body portion 28 includes a clad 44 of a first thermally conductive material, such as nickel, and a core 46 of a second thermally conductive material, such as copper, enrobed by the clad 44. The thermally conductive material of the core 46 is also electrically conductive.

As shown in FIG. 2, the center body portion 28 has a first diameter $D_1$ extending perpendicular to the longitudinal center body portion 28. The first diameter $D_1$ of the center body portion 28 is typically 2.69 mm, 2.16 mm, 1.83 mm, or 1.32 mm. However, it will be understood by those of ordinary skill in the art that the center body portion 28 may have other dimensions. In one embodiment, as shown in FIGS. 2-6 and 9-11, the center body portion 28 presents a center hole 48 extending longitudinally along the center axis A and facing outwardly of the center electrode 22 at the center firing end 42. In the embodiment of FIG. 10, the center hole 48 and the center firing tip 32 are spaced from the core 46 of the center body portion 28 by the clad 44. In the embodiment of FIG. 11, the center hole 48 and the center firing tip 32 abut the core 46. In another embodiment, shown in FIGS. 3-10, the center electrode 22 has a diameter reduction, referred to as a third diameter $D_3$, along the center body portion 28 in a region spaced from the center firing end 42. In yet another embodiment, as shown in FIGS. 4 and 9, the center electrode 22 has the reduced third diameter $D_3$ along the center body portion 28 in the region spaced from the center firing end 42, and tapers from the center body portion 28 to the center firing end 42 forming a frustum of a cone along a segment of the center body portion 28 adjacent to the center firing end 42. In one embodiment, the third diameter $D_3$ of the center electrode 22 is 2.54 mm, 1.98 mm, 1.65 mm, or 1.16 mm, corresponding to the first diameters $D_1$ examples provided above. However, it will be understood by those of ordinary skill in the art that the center electrode 22 may have other dimensions. The center firing tip 32 also has a cylindrical geometry, but can comprise other shapes.

As alluded to above, at least one of the electrodes 22, 24, but preferably both electrodes 22, 24 include the ceramic firing tip 32, 34. As shown in FIGS. 1-11, the center electrode 22 includes the firing tip 32, referred to as the center firing tip 32, formed of the ceramic material to provide a long-life center firing surface 36 for the spark plug 20. The center firing tip 32 extends transversely from the center firing end 42. The ceramic material of the center firing tip 32 presents the firing surface 36, referred to as a center firing surface 36, which is typically planar and faces outwardly for emitting a spark to ignite the mixture of fuel and air. In another embodiment, the center firing surface 36 is convex (not shown). In one embodiment, as shown in FIGS. 2-6 and 9-11, the center firing tip 32 is disposed in the center hole 48. The center firing tip 32 typically has a second diameter $D_2$ extending perpendicular to the center axis that is less than the first diameter $D_1$ of the center body portion 28. The second diameter $D_2$ of the center firing tip 32 is typically 1.5 mm, 1.0 mm, or 0.7 mm. However, it will be understood by those of ordinary skill in the art that center firing tip 32 may have other dimensions. The center firing tip 32 also has a cylindrical geometry, but can comprise other shapes.

In one embodiment, the center firing tip 32 comprises a monolithic ceramic rivet, as shown in FIGS. 6-8. In yet another embodiment, as shown in FIG. 8, the firing tip 32, 34 includes a first section and a second section, wherein the first section is disposed on the body portion 28, 30 and includes a metal material, and the second section is disposed on the first section and includes the ceramic material.

The center firing tip 32 includes a ceramic material presenting the center firing surface 36, preferably a monolithic and electrically conductive or semi-conductive ceramic material. Typically, the center firing tip 32 is funned entirely of the electronically conductive ceramic material. In one embodiment, the ceramic material of the center firing tip 32 has an electrical conductivity of at least $10^6$ S/m. The appropriate ceramic material is used in the construction of the center firing tip 32, depending on the level of resistance desired and the temperatures to which the center electrode 22 is exposed. Further, the ceramic material can be provided as a homogeneous material over the entire structure of the center firing tip 32, or as a gradient or a composite. In one preferred embodiment, the ceramic material includes at least one of one of Titanium Diboride; Silicon Carbide; and Ternary Silicides, Nitrides and Carbides, such as Molybdenum Silicide Carbide ($Mo_5Si_3C$) or Titanium Carbonitride (TiCN), for example. Other examples of ceramic materials that can be used to form the center firing tip 32 are disclosed in U.S. patent application Ser. Nos. 12/200,244; 12/201,567; and 12/201,590, each to the present inventor, William J. Walker, Jr.

In one embodiment, the center tiring tip 32 is formed of a ceramic material disclosed in U.S. patent application Ser. No. 12/200,244. The center firing tip 32 of this embodiment is preferably constructed entirely of a solid, one-piece, monolithic conductive or semi-conductive ceramic material. The ceramic materials can include, by way of example and without limitation, oxides, borides, nitrides, carbides, and silicides.

The oxides typically include oxides of transition metals, including monoxides such as TiO; VO; NbO; TaO; MnO; FeO; CoO; NiO; CuO and ZnO, and sesquioxides such as $V_2O_3$; $CrO_3$; $Fe_2O_3$; $RhO_3$; $In_2O_3$; $Th_2O_3$ and $Ga_2O_3$: further including dioxides such as $TiO_2$; $VO_2$; $CrO_2$; $MoO_2$; $WO_2$; $RuO_2$; $ReO_2$; $OsO_2$; $RhO_2$; $IrO_2$; $PbO_2$; $NbO_2$; $MbO_2$; $MnO_2$; $PtO_2$; $GeO_2$ and $SnO_2$. The oxides can also include oxides of two or more metals which include at least one transition metal, including for example, perovskite structures with the general formulation $ABO_3$, where A is La, Ca, Ba, Sr, Y, or Gd, and where B is Sc, Ti, Zr, Hf, Nb, Ta, Mo, W, Re, V, Cr, Mn, Tc, Fe, Ru, Co, Rh, or Ni. Examples include $LaCrO_3$; $LaMnO_3$; $LaFeO_3$; $LaGaO_3$ and $LaCoO_3$.

The borides include, for example, chemical compositions having the formula $M_xB_y$, where M is a metallic element, X is often 1, and Y is often 1, 2 or 6. Other examples include borides having an electrical resistivity in the range of $10^{-5}$ to $10^{-4}$ ohm-cm, and melting points in the range of 1600 to 3200 degrees Celcius. Specific examples include Zirconium Boride ($ZrB_2$; ZrB and $ZrB_{12}$); Hafnium Boride ($HfB_2$); Titanium Boride ($TiB_2$; TiB); Vanadium Boride ($VB_2$; VB); Tungsten Boride ($W_2B_5$); Chromium Boride ($CrB_2$; CrB); Molybdenum Boride beta-MoB, alpha-MoB, $Mo_2B_5$; $Mo_2B$; Niobium Boride ($NbB_2$; NbB); Tantalum Boride ($TaB_2$; TaB); Lanthanum Hexaboride ($LaB_6$); Barium Hexaboride ($BaB_6$); Calcium Hexaboride ($CaB_6$); and Cerium Hexaboride ($CeB_6$).

The nitrides can include, for example, chemical compositions having the formula $M_xN_y$, where M is a metallic element, N is nitride and X and Y are typically 1. The nitrides have an electrical resistivity in the range of $10^{-5}$ to $10^{-4}$ ohm-cm, and melting points in the range of 1400 to 3300 degrees Celcius. Examples of nitrides include Titanium Nitride (TiN); Zirconium Nitride (ZrN); Tantalum Nitride (TaN); Niobium Nitride (NbN); Vanadium Nitride (VN); and Hafnium Nitride (HfN).

Carbides are another possible ceramic material, including for example chemical compositions having the formula $M_xC_y$, where M is a metallic element, C is carbon and X and Y are typically 1. The carbides typically have an electrical resistivity in the range of $10^{-5}$ to $10^{-4}$ ohm-cm, and melting or sublimation points in the range of 1900 to 4000 degrees Celcius. Some examples include, Tantalum Carbide (TaC); Chromium Carbide ($Cr_3C_2$); Molybdenum Carbide (MoC; $Mo_2C$); Tungsten Carbide (WC; $W_2C$); Zirconium Carbide (ZrC); Titanium Carbide (TiC); Niobium Carbide (NbC); Hafnium Carbide (HfC); Vanadium Carbide (VC); Beryllium Carbide ($Be_2C$); Silicon Carbide (SiC); and Boron Carbide ($B_4C$).

The silicides include, for example, chemical compositions having the formula $M_xSi_y$, where M is a metallic element, Si is silicon and X is typically 1 and Y is typically 2. The silicides typically have an electrical resistivity in the range of $10^{-5}$ to $10^{-4}$ ohm-cm, and melting points in the range of 1500 to 2500 degrees Celcius. Some examples include, Molybdenum Silicide ($MoSi_2$); Niobium Silicide ($NbSi_2$); Titanium Silicide ($TiSi_2$); Tungsten Silicide ($WSi_2$; $W_5Si_2$); Chromium Silicide ($CrSi_2$; $Cr_3Si$); and Tantalum Silicide ($TaSi_2$).

In another embodiment, the center firing tip 32 is formed of a ceramic material disclosed in U.S. patent application Ser. No. 12/201,567. In this embodiment, the ceramic material has exceptionally high resistance to high temperature oxidation, erosion and corrosion. The general category of conductive ceramic materials of this embodiment may be referred to as transition metal nitrides, carbides, and carbonitrides due to their superior high temperature properties, including mechanical strength and resistance to certain high temperature oxidation, erosion and corrosion processes. Specifically, the ceramic materials include conductive ceramics of the form $M_{n+1}AX_n$, where M is a transition metal, A is a group IIIA or IVA element, X is nitrogen, or carbon, or both carbon and nitrogen, and n is 1, 2, or 3. While M may be any transition metal suitable for forming a conductive ceramic compound of the form described above, it is preferred that M be selected from a group consisting of Ti, Nb, Ta, V, Cr, Mo, Sc, Zr and Hf. Even more preferably, M may include Ti, Nb, Ta, V, and Cr, in various combinations. A may be any suitable group IIIA or IVA element or elements, including Al, Ga, In, TI, Si, Ge, Sn, Pb, P, As and S, with Al and Si believed to be particularly preferred. X may be carbon, nitrogen or both carbon and nitrogen in various stoichiometric and non-stoichiometric proportions.

Exemplary ceramics of this embodiment include $Ti_2AlC$, $Ti_2AlN$, $Ti_2Al(C0.5, N0.5)$, $Nb_2AlC$, (Nb, Ti)AlC, $Ti_2AlC$, $V_2AlC$, $Cr_2AlC$, $Ti_4AlN_3$, $Ti_3AlC2$, $Ti_2GaC$, $V_2GaC$, $Cr_2GaC$, $Nb_2GaC$, $Mo_2GaC$, $Ta_2GaN$, $Cr_2GaN$, $Sc_2InC$, $Ti_2InC$, $Zr_2InC$, $Nb_2InC$, $Hf_2InC$, $Ti_2InN$, $Zr_2InN$, $Ti_2TlC$, $Zr_2TlC$, $Hf_2TlC$, $Zr_2TlN$, $Ti_3SiC_2$, $Ti_2GeC$, $V_2GeC$, $Cr_2GeC$, $Ti_3GeC_2$, $Ti_2SnC$, $Zr_2SnC$, $Hf_2SnC$, $Hf_2SnN$, $Ti_2PbC$, $Zr_2PbC$, $Hf_2PbC$, $V_2PC$, $Nb_2PC$, $V_2AsC$, $Nb_2AsC$, $Ti_2SC$, $Zr_2SC$, $Nb_2SC$, and $Hf_2SC$. Of these (Nb, Ti)AlC, $Ti_2AlC$, $Va_2AlC$, $Cr_2AlC$, $Ti_4AlN_3$, $Ti_3AlC_2$ and $Ti_3SiC_2$ are believed to be preferred, with $Ti_3SiC_2$ and $Ti_2AlC$ believed to be particularly preferred.

In another embodiment, the center firing tip 32 is formed of a ceramic material disclosed in U.S. patent application Ser. No. 12/201,590. In this embodiment, the center firing tip 32 comprises a composite ceramic structure. The composite structure may have at least two different consistent materials, and can either be a ceramic-ceramic composition, or a ceramic-metal (cermet) composition, depending on the specific attributes sought in the specific application. If constructed as a ceramic-ceramic composite, one exemplary composite structure example includes a composite of silicon nitride ($Si_3N4$) and molybdenum disilicide ($MoSi_2$).

In one preferred embodiment, the center firing tip 32 is formed of a ceramic-ceramic composite having a uniform composition throughout the firing tip 32. In alternate embodiment, the concentration of the composition may vary across the width of the center firing tip 32, in a cross-section taken generally perpendicular to the center axis A. Accordingly, the center firing tip 32 of the alternate embodiment has a non-uniform concentration of the different ceramic materials as viewed along a cross-section taken generally perpendicular to the center axis A. The difference in composition across the width may provide the center firing tip 32 with an insulating peripheral outer portion and a conductive inner portion surrounded and encapsulated by the outer portion. The inner portion may be exposed or closed along the center firing end 42 and along the center firing surface 36.

In one exemplary embodiment, without limitation, the composition of the outer portion of the center firing tip 32 can be provided having about 28 percent $MoSi_2$ and about 72 percent $Si_3N_4$. The composition of the inner portion can be provided having about 43 percent $MoSi_2$ and about 57 percent $Si_3N_4$. Accordingly, the inner portion provides a conductive inner region and the outer portion provides an insulating region. It should be recognized that the aforementioned composite materials are by way of example, and that other materials could be used. For example, the insulating ceramic composite material could be provided as aluminum oxide, aluminum nitride, aluminum oxy-nitride, or silicon aluminum oxynitride, while the conductive ceramic material could be provided as titanium nitride, titanium diboride.

The center firing tip 32 of this embodiment could be provided as a ceramic-metal (cermet) composition, the conductive composite material could be provided as a metal, such as platinum, iridium, nickel or an alloy of nickel, for example.

As previously mentioned, the percent concentration of the each of the insulating and conductive ceramic composite materials can be varied across the width of the center firing tip 32 and/or along the length of the center firing tip 32, depending on the performance requirements desired.

A variety of methods can be used to attach the center firing tip 32 to the center body section. In one embodiment, a braze 50 attaches the center firing tip 32 to the center body portion 28. The brazing can be done using an active braze alloy, such as Ticusil, Gold-ABA, Gold-ABA-V, or other braze alloys provided by Wesgo Metals. Alternatively, reactive air brazing can be used to attach the center firing tip 32 to the center body portion 28. The reactive air brazing typically involves using a copper oxide-silver single phase liquid to join the metal of the center body portion 28 and the ceramic material of the center firing tip 32. The center firing tips 32 of FIGS. 2-4, 7, 8, 10, and 11 may be attached by brazing.

In another embodiment, the center electrode 22 includes a retaining element 52 disposed along the center firing end 42 for attaching the center firing tip 32 to the center body portion 28. In one embodiment, as shown in FIGS. 5 and 6, the retaining element 52 includes a ledge or other mechanical locking feature facing inwardly toward the center axis A. The retaining element 52 and center firing end 42 together present the center hole 48 therebetween for receiving the center firing tip 32 and mechanically attaching the center firing tip 32 to the center body portion 28. In the embodiment of FIG. 6, the retaining element 52 is attached to the center body portion 28 by a laser weld 86. In yet another embodiment, as shown in FIG. 9, the center firing tip 32 is attached to the center body portion 28 by forming indentations 82, holes, grooves, or notches along the center firing tip 32 adjacent the center firing end 42, and melting a portion of the center body portion 28 at the center firing end 42, adjacent the indentations, so that the body portion 28 flows into the indentations and solidifies, providing the melted portion 88 of FIG. 9. The melted portion 88 secures the center firing tip 32 to the center body portion 28.

As shown in FIG. 1, the spark plug 20 further includes other elements such as those typically found in spark plugs 20 of internal combustion engines. For example, the spark plug 20 includes an insulator 56 disposed annularly around the center electrode 22. The insulator 56 extends longitudinally from an insulator upper end 58, along the center body portion 28, toward the center firing end 42, and to an insulator firing end 60. The center firing end 42 projects outwardly of the insulator firing end 60.

The insulator 56 is formed of an electrically insulating material, such as alumina. The insulator 56 preferably has a very low dielectric loss factor, and an electrical conductivity significantly less than the electrical conductivity of the center electrode 22, such as an electrical conductivity of not greater than $10^{-12}$ S/m.

The spark plug 20 of FIG. 1 includes a terminal 62 formed of an electrically conductive material received in the insulator 56 and extending from a first terminal end 64 to a second terminal end 66, which is electrically connected to the center electrode top end 40 of the center electrode 22. The terminal 62 is formed of an electrically conductive material. A resistor layer 68 is disposed between and electrically connects the second terminal end 66 of the terminal 62 and the center electrode top end 40 of the center electrode 22 for transmitting energy from the terminal 62 to the center electrode 22. The resistor layer 68 is formed of an electrically resistive material, such as a glass seal.

The spark plug 20 further includes a shell 70 disposed annularly around and longitudinal along the insulator 56 from an upper shell end 72 to a lower shell end 74. The insulator firing end 60 and the center firing end 42 project outwardly of the lower shell end 74, as shown in FIG. 1. The spark plug 20 engages with the engine by means of a threaded portion of the shell 70, where the threads 84 may be 14 mm, 12 mm, or 10 mm, and preferably 12 mm. However, it will be understood by those of ordinary skill in the art that other threads, or other means of engaging with the engine, can be used. The shell 70 is formed of a metal material, such as steel. The spark plug 20 can include at least one packing element 54, such a gasket, cement, or other sealing compound, disposed between the insulator 56 and the shell 70 for providing a gas-tight seal between the shell 70 and the insulator 56. The packing element 54 can also be disposed between the insulator 56 and the terminal 62.

The ground electrode 24 of the spark plug 20 is attached to the lower shell end 74 of the shell 70. The ground electrode 24 comprises the body portion 30, referred to as a ground body portion 30, extending from a ground electrode top end 76, which is attached to the lower shell end 74, to a ground firing end 78. The ground body portion 30 extends transversely from the lower shell end 74 and curves toward the center electrode 22 to the ground firing end 78.

Like the center body portion 28 of the center electrode 22, the ground body portion 30 also includes a thermally conductive material, which is typically selected from the same group of materials as the thermally conductive material of the center body portion 28, but can be a different material. In one embodiment, the ground body portion 30 includes the clad 44 of the thermally conductive material, such as nickel, enrobing the core 46 of another thermally conductive material, such as copper. The ground body portion 30 has a thermal conductivity sufficient to draw heat away from a ceramic ground firing tip 34. The ground body portion 30 has a thermal conductivity of at least 20 μm-K when measured at 20° C., and preferably at least 35 W/m-K when measured at 20° C.

The ground body portion 30 also has an electrical conductivity of at least $9\times10^5$ S/m. As shown in FIG. 1, the ground body portion 30 has a first length $l_1$ extending parallel to the center axis A. In one embodiment (not shown), the ground body portion 30 includes a clad of a first thermally conductive material, such as nickel, and a core of a second thermally conductive material, such as copper, enrobed by the clad. The thermally conductive material of the core is also electrically conductive.

As alluded to above, the ground electrode 24 preferably includes a firing tip 34, referred to as the ground firing tip 34, extending transversely from the ground firing end 78 toward the center firing tip 32. The ground firing tip 34 has a second length $l_2$ extending parallel to the center axis A, which is generally less than the first length $l_1$, but may be longer than the first length $l_1$. The ground firing tip 34 also preferably includes one of the ceramic materials described above with regard to the center firing tip 32. The ceramic material of the ground firing tip 34 can be the same as or different from the ceramic material of the center firing tip 32. The ceramic material of the ground firing tip 34 provides the firing surface 36, 38, referred to as a ground firing surface 38, facing the center firing surface 36 and exposed to the combustion chamber.

As shown in FIGS. 1 and 1A, the ground firing surface 38 is spaced and parallel to the center firing surface 36 to provide the spark gap 26 therebetween. However, in an alternate embodiment, only one of the electrodes 22, 24 includes the firing tip 32, 34, and the spark gap 26 is provided in part by another type firing surface of the electrode 22, 24 without the firing tip 32, 34. In one embodiment, the ground firing tip 34 has a rectangular cross-section, but can comprise a variety of shapes, being the same as or different from the center firing tip 32. The ground firing tip 34 can be attached to the ground body portion 30 by a variety of methods, such as those discussed with regard to the center firing tip 32 and the center body portion 28. In one embodiment, the ground body portion 30 presents a ground hole 80 extending longitudinally along the center axis A and facing outwardly of the ground electrode 24 at the ground firing end 78.

Another aspect of the invention provides a method of forming the spark plug 20 described above. The method includes providing the electrode 22, 24 by disposing the firing tip 32, 34 including the ceramic material on the body portion 28, 30 including the thermally conductive material. As alluded to above, the method can include disposing the ceramic firing tip 32, 34 on the center electrode 22, the ground electrode 24, or both. In one embodiment, the method includes forming a hole 48, 80 along the center axis A, and disposing the firing tip 32, 34 in the hole 48, 80.

In another embodiment, the method of forming the spark plug 20 includes brazing the firing tip 32, 34 to the body portion 28, 30. As stated above, the brazing step can include using an active braze alloy, such as Ticusil, Gold-ABA, Gold-ABA-V, or other braze alloys provided by Wesgo Metals. Alternatively, the brazing can include reactive air brazing, which typically involves using a copper oxide-silver single phase liquid to join the metal of the body portion 28, 30 and the ceramic material of the firing tip 32, 34.

Alternatively, the method can include mechanically attaching the firing tip 32, 34 to the body portion 28, 30. A retaining element 52 can be used to attach the firing tip 32, 34 to the body portion 28, 30. In one embodiment, the method includes brazing or laser welding the retaining element 52 to the body portion 28, 30. In yet another embodiment, the firing tip 32, 34 is attached to the body portion 28, 30 by forming indentations 82, holes, grooves, or notches along sides of the firing tip 32, 34 adjacent the body portion 28, 30, heating, and melting a portion of the body portion 28, 30 at the firing end 42, 78 adjacent the holes. The body portion 28, 30 flows into the holes and solidifies, providing the melted portion 88 of FIG. 9, securing the firing tip 32, 34 to the body portion 28, 30.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. In addition, the reference numerals in the claims are merely for convenience and are not to be read in any way as limiting.

ELEMENT LIST

| Element Symbol | Element Name |
|---|---|
| A | axis |
| 20 | spark plug |
| 22 | center electrode |
| 24 | ground electrode |
| 26 | spark gap |
| 28 | center body portion |
| 30 | ground body portion |
| 32 | center firing tip |
| 34 | ground firing tip |
| 36 | center firing surface |

-continued

| Element Symbol | Element Name |
|---|---|
| 38 | ground firing surface |
| 40 | center electrode top end |
| 42 | center firing end |
| 44 | clad |
| 46 | core |
| 48 | center hole |
| 50 | braze |
| 52 | retaining element |
| 54 | packing element |
| 56 | insulator |
| 58 | insulator upper end |
| 60 | insulator firing end |
| 62 | terminal |
| 64 | first terminal end |
| 66 | second terminal end |
| 68 | resistor layer |
| 70 | shell |
| 72 | upper shell end |
| 74 | lower shell end |
| 76 | ground electrode top end |
| 78 | ground firing end |
| 80 | ground hole |
| 82 | indentation |
| 84 | threads |
| 86 | weld |
| 88 | melted portion |
| $D_1$ | first diameter |
| $D_2$ | second diameter |
| $D_3$ | third diameter |
| $l_1$ | first length |
| $l_2$ | second length |

What is claimed is:

1. A spark plug for igniting a mixture of fuel and air of an internal combustion engine, comprising:

a center electrode having a center body portion extending longitudinally from a center electrode top end to a center firing end;

a ground electrode having a ground body portion extending from a ground electrode top end toward said center firing end and presenting a ground firing end facing said center firing end;

said body portion of at least one of said electrodes consisting of metal;

a firing tip disposed on said firing end of said body portion consisting of metal;

said firing tip providing a firing surface spaced from the other one of said electrodes by a spark gap;

said firing tip formed entirely of electrically conductive ceramic material, said ceramic material including at least one oxide selected from the group consisting of TiO, VO, NbO, TaO, MnO, FeO, CoO, NiO, CuO, ZnO, $V_2O_3$, $CrO_3$, $Fe_2O_3$, $RhO_3$, $In_2O_3$, $Th_2O_3$, $Ga_2O_3$, $TiO_2$, $VO_2$, $CrO_2$, $MoO_2$, $WO_2$, $RuO_2$, $ReO_2$, $OsO_2$, $RhO_2$, $IrO_2$, $PbO_2$, $NbO_2$, $MbO_2$, $MnO_2$, $PtO_2$, $GeO_2$, $SnO_2$, and perovskite structures with the general formulation $ABO_3$, where A is one of La, Ca, Ba, Sr, Y, Gd, and where B is one of Sc, Ti, Zr, Hf, Nb, Ta, Mo, W, Re, V, Cr, Mn, Tc, Fe, Ru, Co, Rh, Ni.

2. The spark plug of claim 1 wherein said body portion consisting of metal has a thermal conductivity of at least 20 W/m-K.

3. The spark plug of claim 1 wherein said body portion consisting of metal has a thermal conductivity of at least 35 W/m-K.

4. The spark plug of claim 1 wherein said ceramic material is monolithic.

5. The spark plug of claim 1 wherein said firing surface consists of said ceramic material.

6. The spark plug of claim 1 wherein said firing tip comprises a composite.

7. The spark plug of claim 6 wherein composite includes two different ceramic materials.

8. The spark plug of claim 1 including a laser weld between said firing tip and said body portion consisting of metal.

9. The spark plug of claim 1 including a braze between said firing tip and said body portion consisting of metal.

10. The spark plug of claim 1 including a retaining element attaching said firing tip to said body portion consisting of metal.

11. The spark plug of claim 1 wherein said body portion is a center body portion extending along a center axis and has a first diameter extending perpendicular to said center axis; said firing tip is a center firing tip extending transversely from said center body portion; and said center firing tip has a second diameter extending perpendicular to said center axis and being less than said first diameter of said center body portion.

12. The spark plug of claim 1 wherein said body portion consisting of metal includes a hole facing outwardly and said firing tip is disposed in said hole.

13. An electrode for an ignition device, comprising:

a body portion extending from a top end to a firing end;

said body portion consisting of metal;

a firing tip disposed on said firing end of said body portion;

said firing tip providing a firing surface for being spaced from another electrode and presenting a spark gap therebetween;

said firing tip formed entirely of electrically conductive ceramic material, said ceramic material including at least one oxide selected from the group consisting of TiO, VO, NbO, TaO, MnO, FeO, CoO, NiO, CuO, ZnO, $V_2O_3$, $CrO_3$, $Fe_2O_3$, $RhO_3$, $In_2O_3$, $Th_2O_3$ $Ga_2O_3$, $TiO_2$, $VO_2$, $CrO_2$, $MoO_2$, $WO_2$, $RuO_2$, $ReO_2$, $OsO_2$, $RhO_2$, $IrO_2$, $PbO_2$, $NbO_2$, $MbO_2$, $MnO_2$, $PtO_2$, $GeO_2$, $SnO_2$, and perovskite structures with the general formulation $ABO_3$, where A is one of La, Ca, Ba, Sr, Y, Gd, and where B is one of Sc, Ti, Zr, Hf, Nb, Ta, Mo, W, Re, V, Cr, Mn, Tc, Fe, Ru, Co, Rh, Ni.

14. A spark plug for igniting a mixture of fuel and air of an internal combustion engine, comprising:

a center electrode comprising a center body portion extending longitudinally from a center electrode top end to a center firing end;

said center body portion consisting of metal;

said metal being thermally conductive and electrically conductive;

said metal including nickel;

said center body portion having a thermal conductivity of at least 20 W/m-K;

said center body portion having an electrical conductivity of at least $9\times10^5$ S/m;

said center body portion having a first diameter extending perpendicular to said longitudinal center body portion;

said center electrode including a center firing tip extending transversely from said center firing end;

said center firing tip formed of a ceramic material;

said ceramic material being monolithic;

said ceramic material of said center firing tip being electrically conductive and having a thermal conductivity less than the thermal conductivity of said center body portion;

said ceramic material of said center firing tip having an electrical conductivity of at least $10^6$ S/m;

said ceramic material including at least one oxide selected from the group consisting of TiO, VO, NbO, TaO, MnO, FeO, CoO, NiO, CuO, ZnO, $V_2O_3$, $CrO_3$, $Fe_2O_3$, $RhO_3$, $In_2O_3$ $Th_2O_3$, $Ga_2O_3$, $TiO_2$, $VO_2$, $CrO_2$, $MoO_2$, $WO_2$, $RuO_2$, $ReO_2$, $OsO_2$, $RhO_2$, $IrO_2$, $PbO_2$, $NbO_2$, $MbO_2$, $MnO_2$, $PtO_2$, $GeO_2$, $SnO_2$, and perovskite structures with the general formulation $ABO_3$, where A is one of La, Ca, Ba, Sr, Y, Gd, and where B is one of Sc, Ti, Zr, Hf, Nb, Ta, Mo, W, Re, V, Cr, Mn, Tc, Fe, Ru, Co, Rh, Ni;

said center firing tip having a second diameter being less than said first diameter of said center body portion;

said center firing tip having a cylindrical geometry;

said ceramic material of said center firing tip presenting a center firing surface being planar and facing outwardly for emitting a spark to ignite the mixture of fuel and air;

a braze attaching said center firing tip to said center body portion;

an insulator disposed annularly around said center electrode;

said insulator extending longitudinally from an insulator upper end along said center body portion toward said center firing end and to an insulator firing end such that said center firing end projects outwardly of said insulator firing end;

said insulator including an electrically insulating material;

said electrically insulating material including alumina;

said insulator having an electrical conductivity less than the electrical conductivity of said center electrode;

said insulator having a thermal conductivity less than the thermal conductivity of said center electrode;

a terminal received in said insulator and extending from a first terminal end to a second terminal end electrically connected to said center electrode top end;

said terminal formed of an electrically conductive material;

a resistor layer disposed between and electrically connecting said second terminal end and said center electrode top end for transmitting energy from said terminal to said center electrode;

said resistor layer formed of an electrically conductive material;

said resistor layer comprising a glass seal;

a shell disposed annularly around and longitudinal along said insulator from an upper shell end to a lower shell end such that said insulator firing end and said center firing end project outwardly of said lower shell end;

said shell being formed of a metal material;

said metal material of said shell being steel;

a ground electrode including a ground body portion including a ground top end attached to said lower shell end and extending transversely from said lower shell end and curving toward said center electrode and presenting a ground firing end facing said center electrode;

said ground body portion consisting of said metal of said center electrode;

said ground body portion having a thermal conductivity of at least 20 W/m-K;

said ground body portion having an electrical conductivity of at least $9\times10^5$ S/m;

said ground electrode including a ground firing tip extending transversely from said ground firing end toward said center firing tip;

said ground firing tip including said ceramic material;

said ceramic material of said ground firing tip being the same as said ceramic material of said center firing tip;

said ceramic material of said ground firing tip presenting a ground firing surface facing said center firing surface;

said ground firing surface being spaced and parallel to said center firing surface to provide a spark gap therebetween;

said ground firing tip having a cylindrical geometry;

a braze attaching said ground firing tip to said ground body portion;

at least one packing element disposed between said insulator and said shell for providing a gas-tight seal between said shell and said insulator; and said packing element being disposed between said insulator and said terminal.

15. A method of forming a spark plug for igniting a mixture of fuel and air of an internal combustion engine, comprising:

providing a center electrode having a center body portion extending longitudinally from a center electrode top end to a center firing end;

providing a ground electrode having a ground body portion extending from a ground electrode top end toward the center firing end and presenting a ground firing end facing the center firing end;

disposing a firing tip formed entirely of electrically conductive ceramic material on the firing end of the body portion of at least one of the electrodes; and spacing the firing tip including the ceramic material from the other one of the electrodes by a spark gap; wherein the body portion of the at least one electrode consists of metal, and the ceramic material of the firing tip includes at least one oxide selected from the group consisting of TiO, VO, NbO, TaO, MnO, FeO, CoO, NiO, CuO, ZnO, $V_2O_3$, $CrO_3$, $Fe_2O_3$, $RhO_3$, $In_2O_3$, $Th_2O_3$, $Ga_2O_3$, $TiO_2$, $VO_2$, $CrO_2$, $MoO_2$, $WO_2$, $RuO_2$, $ReO_2$, $OsO_2$, $RhO_2$, $IrO_2$, $PbO_2$, $NbO_2$, $MbO_2$, $MnO_2$, $PtO_2$, $GeO_2$, $SnO_2$, and perovskite structures with the general formulation $ABO_3$, where A is one of La, Ca, Ba, Sr, Y, Gd, and where B is one of Sc, Ti, Zr, Hf, Nb, Ta, Mo, W, Re, V, Cr, Mn, Tc, Fe, Ru, Co, Rh, Ni.

16. The method of claim 15 including laser welding the firing tip to the body portion consisting of metal.

17. The method of claim 15 including forming a hole facing outwardly in the body portion consisting of metal and disposing the firing tip in the hole.

18. The spark plug of claim 13 wherein said oxides include perovskite structures with the general formulation $ABO_3$, where A is one of La, Ca, Ba, Sr, Y, Gd, and where B is one of Sc, Ti, Zr, Hf, Nb, Ta, Mo, W, Re, V, Cr, Mn, Tc, Fe, Ru, Co, Rh, and Ni.

19. The spark plug of claim 18 where B is Cr.

20. The method of claim 15 wherein the oxides include perovskite structures with the general formulation $ABO_3$, where A is one of La, Ca, Ba, Sr, Y, Gd, and where B is one of Sc, Ti, Zr, Hf, Nb, Ta, Mo, W, Re, V, Cr, Mn, Tc, Fe, Ru, Co, Rh, and Ni.

21. The method of claim 20 where B is Cr.

* * * * *

UNITED STATES PATENT AND TRADEMARK OFFICE

CERTIFICATE OF CORRECTION

PATENT NO. : 8,614,541 B2
APPLICATION NO. : 13/279418
DATED : December 24, 2013
INVENTOR(S) : Walker, Jr.

It is certified that error appears in the above-identified patent and that said Letters Patent is hereby corrected as shown below:

In the Specification:

| Column: | Line: | |
|---|---|---|
| 4 | 38 | "is funned" should read: "is formed" |
| 4 | 56 | "center tiring tip" should read: "center firing tip" |
| 6 | 7 | "TI" should read: "TL" |
| 8 | 35 | "at least 20 um-K" should read: "at least 20 w/m-K" |

Signed and Sealed this
First Day of April, 2014

Michelle K. Lee

Michelle K. Lee
*Deputy Director of the United States Patent and Trademark Office*